US010309175B2

(12) United States Patent
Mailand

(10) Patent No.: US 10,309,175 B2
(45) Date of Patent: Jun. 4, 2019

(54) HIGH FLOW DOWNHOLE LOCK

(71) Applicant: Tejas Research & Engineering LLC, The Woodlands, TX (US)

(72) Inventor: Jason C. Mailand, The Woodlands, TX (US)

(73) Assignee: Tejas Research & Engineering LLC, The Woodlands, TX (US)

( * ) Notice: Subject to any disclaimer, the term of this patent is extended or adjusted under 35 U.S.C. 154(b) by 192 days.

(21) Appl. No.: 15/404,258

(22) Filed: Jan. 12, 2017

(65) Prior Publication Data

US 2018/0195356 A1 Jul. 12, 2018

(51) Int. Cl.
*E21B 23/02* (2006.01)

(52) U.S. Cl.
CPC ..... *E21B 23/02* (2013.01)

(58) Field of Classification Search
CPC ..... E21B 23/00; E21B 23/01; E21B 23/02; E21B 23/03; E21B 23/04
See application file for complete search history.

(56) References Cited

U.S. PATENT DOCUMENTS 2,698,056 A 12/1954 Marshall et al.
3,874,447 A * 4/1975 McGowen, Jr. ..... E21B 23/03 166/214
4,479,539 A 10/1984 Tamplen et al.
4,488,596 A 12/1984 Akkerman
4,545,434 A 10/1985 Higgins
4,554,972 A 11/1985 Merritt
4,595,054 A 6/1986 Schroeder
6,516,889 B1 2/2003 Lembcke et al.
8,567,509 B1 * 10/2013 Kippola ..... E21B 34/102 166/334.1
2012/0247767 A1 * 10/2012 Themig ..... E21B 21/103 166/289
2013/0299176 A1 * 11/2013 Yokley ..... E21B 33/1208 166/336
2014/0166315 A1 * 6/2014 Black ..... E21B 23/02 166/382

* cited by examiner

*Primary Examiner* — Brad Harcourt
*Assistant Examiner* — David Carroll
(74) *Attorney, Agent, or Firm* — Basil M. Angelo; Angelo IP

(57) ABSTRACT

A high flow downhole lock assembly includes a mandrel with a plurality of external collet finger detents disposed about an exterior surface and an unobstructed inner diameter configured for flow, an external collet with a plurality of collet fingers disposed about an interior surface, and a dog housing with a plurality of extendable retaining dogs. When transitioning to a set configuration, a portion of the mandrel travels within the external collet, the plurality of collet fingers come to rest in one or more of the external collet finger detents, and the plurality of extendable retaining dogs are extended.

17 Claims, 13 Drawing Sheets

HIGH FLOW DOWNHOLE LOCK

BACKGROUND OF THE INVENTION

A conventional downhole lock assembly is used to locate and retain various downhole tools in a wellbore. A running tool is removably attached to a top distal end of the lock assembly to run the assembly into the wellbore and a tool is attached to a bottom distal end. Commonly used tools include flow control and safety tools. During trip in, the lock assembly and tool are landed in a conventional landing nipple disposed downhole. Upon reaching the setting depth, the running tool is jarred downward to shear a plurality of setting pins that lock the assembly in the landing nipple in the wellbore. The running tool may then be removed and the lock assembly and tool may provide the flow control or safety function.

BRIEF SUMMARY OF THE INVENTION

According to one aspect of one or more embodiments of the present invention, a high flow downhole lock assembly includes a mandrel with a plurality of external collet finger detents disposed about an exterior surface and an unobstructed inner diameter configured for flow, an external collet with a plurality of collet fingers disposed about an interior surface, and a dog housing with a plurality of extendable retaining dogs. When transitioning to a set configuration, a portion of the mandrel travels within the external collet, the plurality of collet fingers come to rest in one or more of the external collet finger detents, and the plurality of extendable retaining dogs are extended.

Other aspects of the present invention will be apparent from the following description and claims.

DETAILED DESCRIPTION OF THE INVENTION

Figure 1:
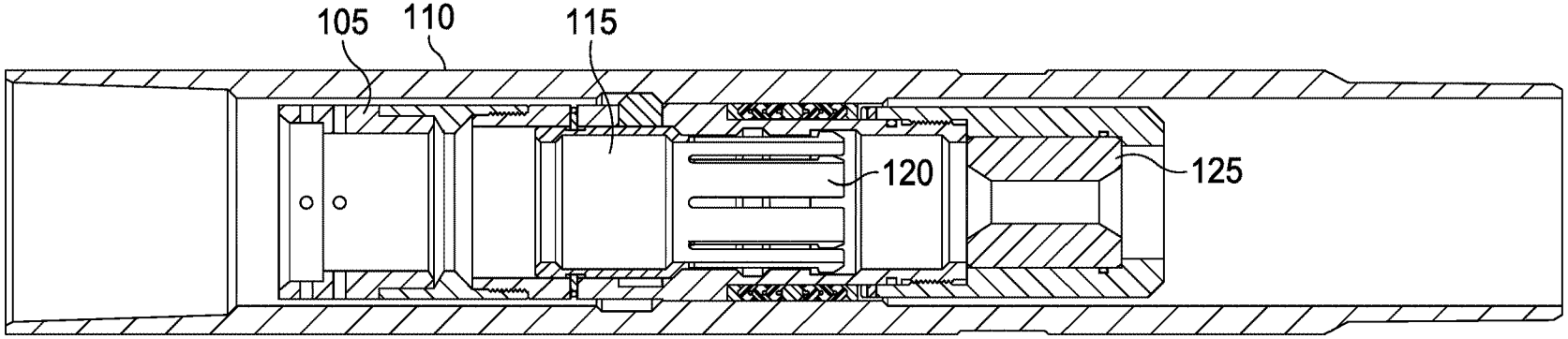
FIG. 1 PRIOR ART
FIG. 1 shows a cross-sectional view of conventional downhole lock assembly set in a landing nipple.

One or more embodiments of the present invention are described in detail with reference to the accompanying figures. For consistency, like elements in the various figures are denoted by like reference numerals. In the following detailed description of the present invention, specific details are set forth in order to provide a thorough understanding of the present invention. In other instances, well-known features to one of ordinary skill in the art are not described to avoid obscuring the description of the present invention.

Conventional downhole lock assemblies are primarily used in production applications (flow from the bottom of the wellbore up) such as, for example, to hold back trapped pressure originating from the bottom of the wellbore. In production applications, flow interfaces primarily with the tool disposed at a bottom distal end of the lock assembly and the obstructed inner diameter of the lock assembly is less relevant since there is little to no flow therethrough. However, in injection applications (flow from the surface of the wellbore down), conventional downhole lock assemblies are less effective because of the obstructed inner diameter of the lock assembly. The internal profile of the inner diameter of a conventional downhole lock assembly is not uniform or smooth and includes obstructions that cause erosional turbulence within the lock. The turbulence is caused by the abrupt diametric changes within the inner diameter because at least portions of the locking mechanism are located within the internal profile of the inner diameter of the lock assembly. The non-uniform and obstructed internal profile of the inner diameter of the lock assembly gives rise to erosional turbulence, poor flow characteristics, and lower injection efficiencies. In addition, reliability and operational life is substantially reduced. As such, conventional downhole lock assemblies are not suitable for high flow rate injection applications.

Another drawback of conventional downhole lock assemblies is that, because portions of the locking mechanism are disposed within the inner diameter of the lock assembly, when the shear pins or setting screws used to set the lock assembly in a landing nipple are sheared, sheared portions may fall within the inner diameter of the lock assembly, cause damage to the inner diameter of the lock assembly due to turbulence, and ultimately foul the flow control or safety tool, also requiring the removal and replacement of the lock assembly and tool.

Accordingly, in one or more embodiments of the present invention, a high flow downhole lock assembly provides all setting components outside the lock assembly such that the inner diameter of the assembly is larger, unobstructed, smooth, and free from encumbrance. Once set, the unobstructed inner diameter allows for higher injection rates, reduced turbulence, improved flow characteristics, reduced erosion, lower internal velocities, lower differential pressures, and lower installed reaction forces than conventional lock assemblies. Advantageously, the high flow downhole lock assembly may be used in both production and injection operations, including high flow rate injection operations.

FIG. 1 shows a cross-sectional view of conventional downhole lock assembly 105 and orifice tool 125 set in a landing nipple 110. Conventional downhole lock assembly 105 may be a conventional DB-6 type lock assembly that is commonly used in industry. As shown in the cross-sectional view, aspects of the locking mechanism may be disposed within an internal profile of the inner diameter 115 of the lock assembly 105. For example, an internal collet 120 may be disposed, at least partially, within the inner diameter 115. In addition, inner diameter 115 includes a number of abrupt diametric changes that obstruct flow therethrough. As such, the internal profile of the inner diameter 115 of the lock assembly 105 is not uniform or smooth and includes obstructions that cause erosional turbulence within the lock assembly 105. The turbulence is caused in part by the abrupt diametric changes within the inner diameter 115 and the portions of the locking mechanism that are located within the internal profile of the inner diameter 115 of the lock assembly 105. The non-uniform and obstructed internal profile of the inner diameter 115 of the lock assembly 105 gives rise to erosional turbulence, poor flow characteristics, and lower injection efficiencies that render lock assembly 105 unsuitable for high flow rate injection applications.

Figure 2:
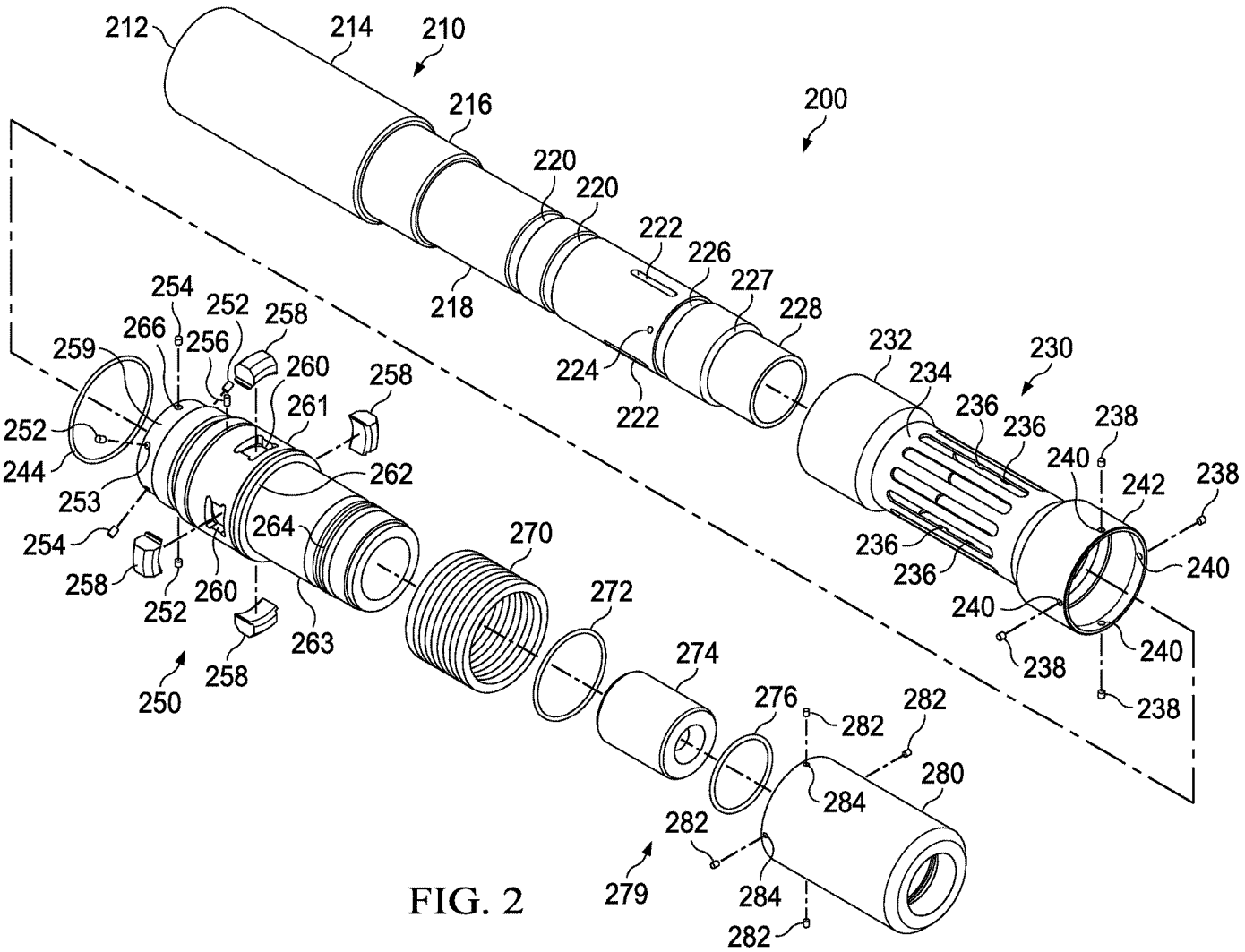
FIG. 2 shows an exploded isometric view of a high flow downhole lock assembly and nose piece attachment in accordance with one or more embodiments of the present invention.

FIG. 2 shows an exploded isometric view of a high flow downhole lock assembly 200 and nose piece attachment in accordance with one or more embodiments of the present invention. A high flow downhole lock assembly 200 may include a mandrel 210, an external collet 230, and a dog housing 250. Mandrel 210 may include an outer mandrel portion 214 having a first outer diameter smaller than a landing nipple inner diameter (not shown), a first inner mandrel portion 216 having a second outer diameter smaller than the first outer diameter of the outer mandrel portion 214, a second inner mandrel portion 218 having a third outer diameter smaller than the second outer diameter of the first inner mandrel portion 216, and a third inner mandrel portion 228 having a fourth outer diameter smaller than the third outer diameter of the second inner mandrel portion 218. A plurality of external collet detents 220 may be disposed about the exterior surface of the second inner mandrel portion 218. Each external collet detent 220 may be a groove formed about a circumference of an exterior surface of the second inner mandrel portion 218. Mandrel 210 may include a plurality of retention pin slots 222 disposed along a longitudinal axis about an exterior surface of the second inner mandrel portion 218, a recovery shear pin groove disposed about the exterior of the second inner mandrel portion 218, and a sloped interface 227 between the second inner mandrel portion 218 and the third inner mandrel portion 228. In addition, mandrel 210 may include one or more shear screw spotfaces 224. A top distal end 212 of outer mandrel portion 214 of mandrel 210 may be configured to connect to a running tool (not shown) during tripping in or a connection (not shown) during operation. Mandrel 210 may include an unobstructed inner diameter (not independently shown) configured for high flow rates.

External collet 230 may include a first distal interface portion 232 having a first inner diameter configured to receive a first inner mandrel portion 216 of mandrel 210, a collet portion 234 having a second inner diameter configured to receive a second inner mandrel portion 218 of mandrel 210, and a second distal interface portion 242 having the first inner diameter configured to connect to a first distal end of dog housing 250. External collet 230 may include a plurality of collet fingers 236 disposed about an interior surface of the second inner diameter of collet portion 234. Second distal interface portion 242 may include a plurality of collet set screw receivers 240 configured to receive collet set screws 238 that secure the second distal interface portion 242 of external collet 230 to a first distal end of dog housing 250. A garter spring 244 sits on top of the recovery shear pins 256 and drives them down into the recovery shear pin groove 226 once the lock assembly 200 is set in a landing nipple (not shown).

Dog housing 250 may include a first dog housing portion 259 having a first outer diameter configured to connect with the first inner diameter of the second distal interface portion 242 of external collet 230, a second dog housing portion 261 having a second outer diameter larger than the first outer diameter of first dog housing portion 259, and a third dog housing portion 263 having a third outer diameter smaller than the second outer diameter of the second dog housing portion 261 that is configured to connect to a nose piece attachment 279. First dog housing portion 259 may include a plurality of retention pin holes 266 configured to receive a plurality of retention pins 254 that may be disposed within the plurality of retention pin slots 222 of mandrel 210. The retention pins 254 allow the mandrel 210 to translate within the dog housing 250 during setting of the lock assembly 200. First dog housing portion 259 may also include a plurality of shear screws 252 to be disposed within a plurality of threaded shear screw holes 253 that interface with the shear screw spotface 224 of mandrel 210. The shear screws 252 provide resistance to the movement of the mandrel 210 during the setting of lock assembly 200 in a landing nipple (not shown). First dog housing portion 259 may also include a plurality of recovery shear pins 256 that are held in place by garter spring 244. The recovery shear pins 256 ride on the second inner mandrel portion 218 in the running configuration and fall into the recovery shear pin groove 226 of the mandrel 210 in the set configuration. Second dog housing portion 261 may include a plurality of retaining dog ports 260 disposed about a circumference of second dog housing portion 261. A plurality of extendable retaining dogs 258 may be disposed in the plurality of retaining dog ports 260. The plurality of extendable retaining dogs 258 may be interchangeable to mate with a particular type of landing nipple (not shown). Third dog housing portion 263 may include a threaded nose interface 264 for securing a nose piece 280.

A nose piece attachment 279 may include a seal stack 270, a first o-ring 272, an insert 274, a second o-ring 276, a nose piece 280, and a plurality of nose set screws 282. Seal stack 270 may slide over a portion of third dog housing portion 263. First o-ring 272 may then slide over a portion of third dog housing portion 263, placed on the seal stack 270 side of threaded nose interface 264. Insert 274 may be inserted with second o-ring 276 into nose piece 280. Nose piece 280, with insert 274 and second o-ring 276 disposed therein, may be connected to threaded nose interface 264. The plurality of nose set screws 282 may be threaded through a plurality of nose set screw receivers 284 of nose piece 280 to further secure nose piece 280 to the third dog housing portion 263. Nose piece attachment 279 may be a production safety valve, an injection safety valve, an anti-surge valve, a fixed orifice valve, an injection orifice, a storm choke, an isolation plug, a gauge, a cement retainer, or a combination thereof.

In certain embodiments, mandrel 210, external collet 230, dog housing 250, and nose piece attachment 279 may be composed of steel. In other embodiments, they may be composed of steel alloys. In still other embodiments, they may be composed of corrosion resistant alloys. One of ordinary skill in the art will recognize that any other suitable material may be used in accordance with one or more embodiments of the present invention. In certain embodiments, seal stack 270, first o-ring 272, and second o-ring 276 may be composed of elastomers. In other embodiments, they may be composed of non-elastomers. In still other embodiments, they may be composed of a combination of elastomers and non-elastomers. One of ordinary skill in the art will recognize that any other suitable material may be used in accordance with one or more embodiments of the present invention. In certain embodiments, screws and pins meant to shear, such as, for example, shear screws 252 and recovery shear pins 256 may be composed of brass.

Figure 3A:
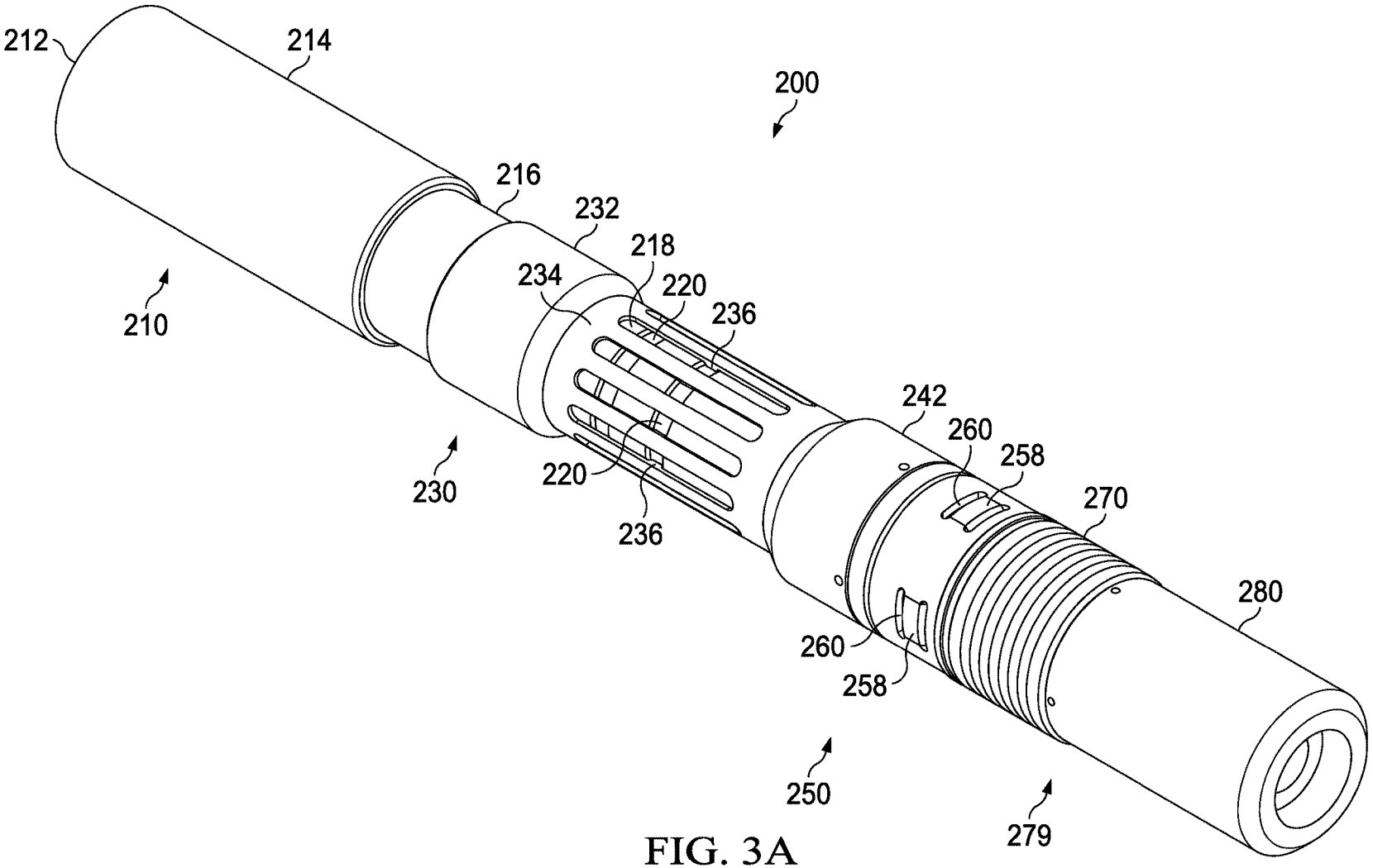
FIG. 3A shows an isometric view of a high flow downhole lock assembly and nose piece attachment in a running configuration in accordance with one or more embodiments of the present invention.
Figure 3B:
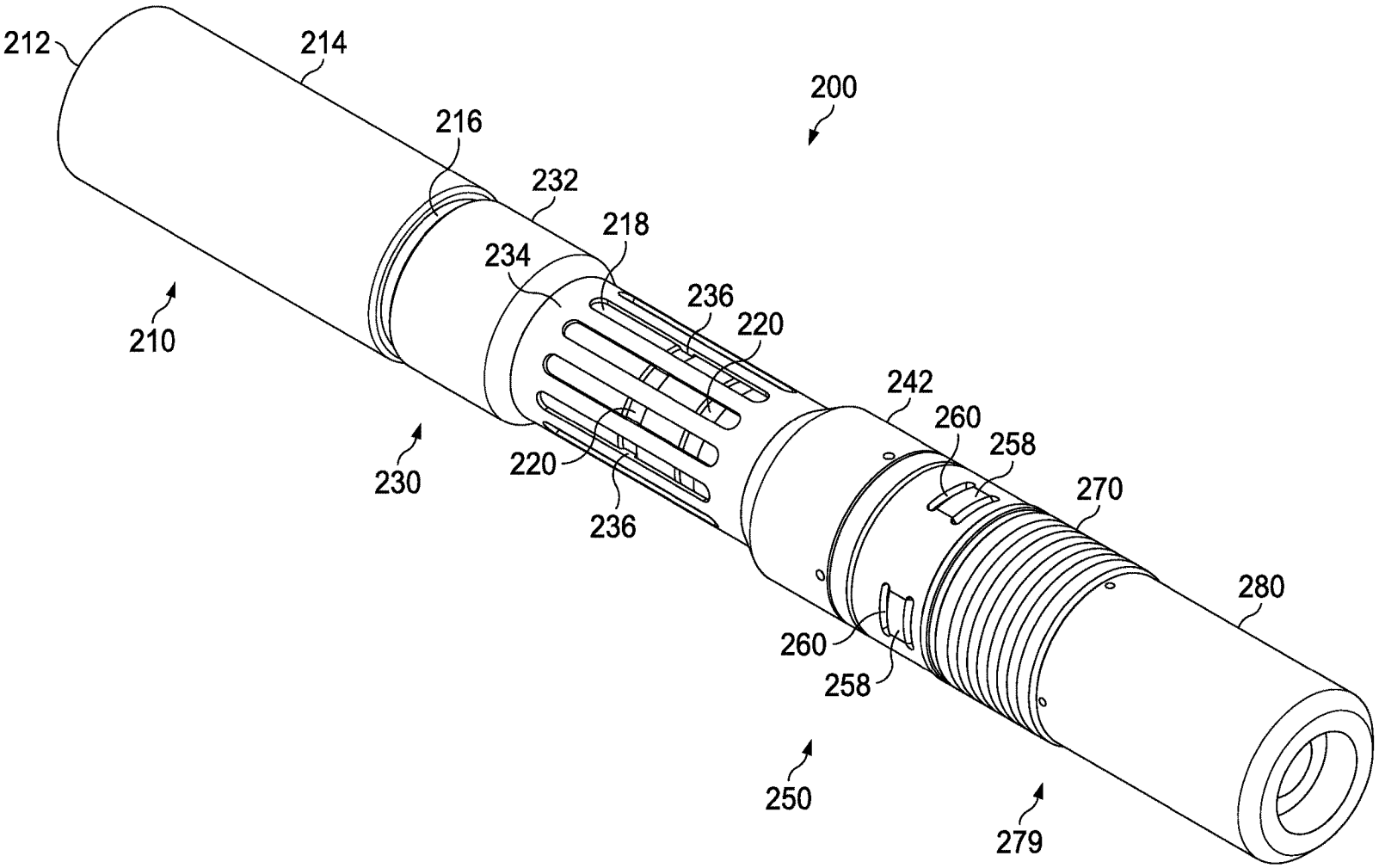
FIG. 3B shows an isometric view of a high flow downhole lock assembly and nose piece attachment in a set configuration in accordance with one or more embodiments of the present invention.

FIG. 3A shows an isometric view of a high flow downhole lock assembly 200 and nose piece attachment 279 in a running configuration in accordance with one or more embodiments of the present invention. In the running configuration, a running tool (not shown) may be attached to the internal running profile (292 of FIG. 4A) of dog housing 250 to trip in the lock assembly 200 and nose piece attachment 279 downhole. In this running configuration, a plurality of collect fingers 236 may rest in a distal collet finger detent 220 nearest the nose piece attachment 279. The plurality of extendable retaining dogs 258 may be seated within the plurality of retaining dog ports 260. In this running configuration, lock assembly 200 and nose piece attachment 279 may be landed in a landing nipple (not shown). Once a sufficient depth is reached, a jarring action may be applied to the running tool (not shown) to force the mandrel 210 downward in the direction of the bottom of the wellbore (not shown). Mandrel 210 travels within external collet 230, the plurality of collet fingers come to rest in an external collet finger detent 220 nearest the distal end 212 of mandrel 210, the plurality of extendable retaining dogs 258 are extended outside of the plurality of retaining dog ports 260, and the recovery shear pins (256 of FIG. 4A) fall into the recovery shear pin groove 226 of mandrel 210. When the plurality of extendable retaining dogs 258 are extended outside of the dog housing 250, they secure the lock assembly 200 in the landing nipple (not shown). Continuing, FIG. 3B shows an isometric view of a high flow downhole lock assembly 200 and nose piece attachment 279 in a set configuration in accordance with one or more embodiments of the present invention. In this set configuration, the plurality of collet fingers 236 come to rest in a distal collet finger detent 220 nearest the outer mandrel portion 214 of mandrel 210. The plurality of extendable retaining dogs 258 are extended outside of the plurality of retaining dog ports 260, thereby securing lock assembly 200 in the landing nipple (not shown).

Figure 4A:
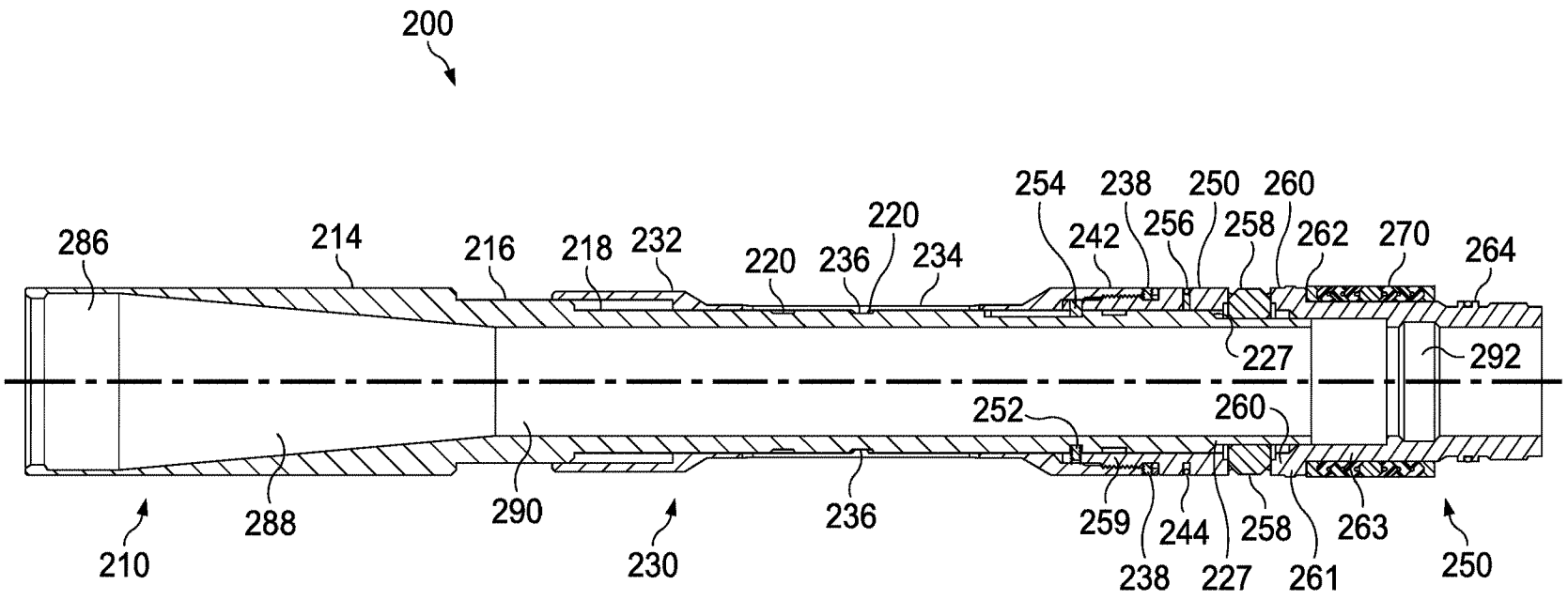
FIG. 4A shows a cross-sectional view of a high flow downhole lock assembly in a running configuration in accordance with one or more embodiments of the present invention.

FIG. 4A shows a cross-sectional view of a high flow downhole lock assembly 200 in a running configuration in accordance with one or more embodiments of the present invention. In this view, first inner mandrel portion 216 is in contact with, but not fully seated within, the first distal interface portion 232 of external collet 230. A plurality of collet fingers 236 may be disposed in distal collet finger detent 220 on the right hand side, corresponding to the location nearest the bottom of the wellbore (not shown). A plurality of extendable retaining dogs 258 may be seated within the plurality of retaining dog ports 260. Outer mandrel portion 214 may include a recovery internal profile 286 configured for removal of lock assembly 200 after use. Outer mandrel portion 214 may also include a smooth flared profile portion 288 that funnels down to an unobstructed and smooth inner diameter 290 of assembly 200. Inner diameter 290 is unobstructed, smooth, and free from encumbrance and configured for maximum flow. In certain embodiments, the unobstructed inner diameter 290 of assembly 200 may be coated with a corrosion resistant coating to enhance the operational life of assembly 200.

Figure 4B:
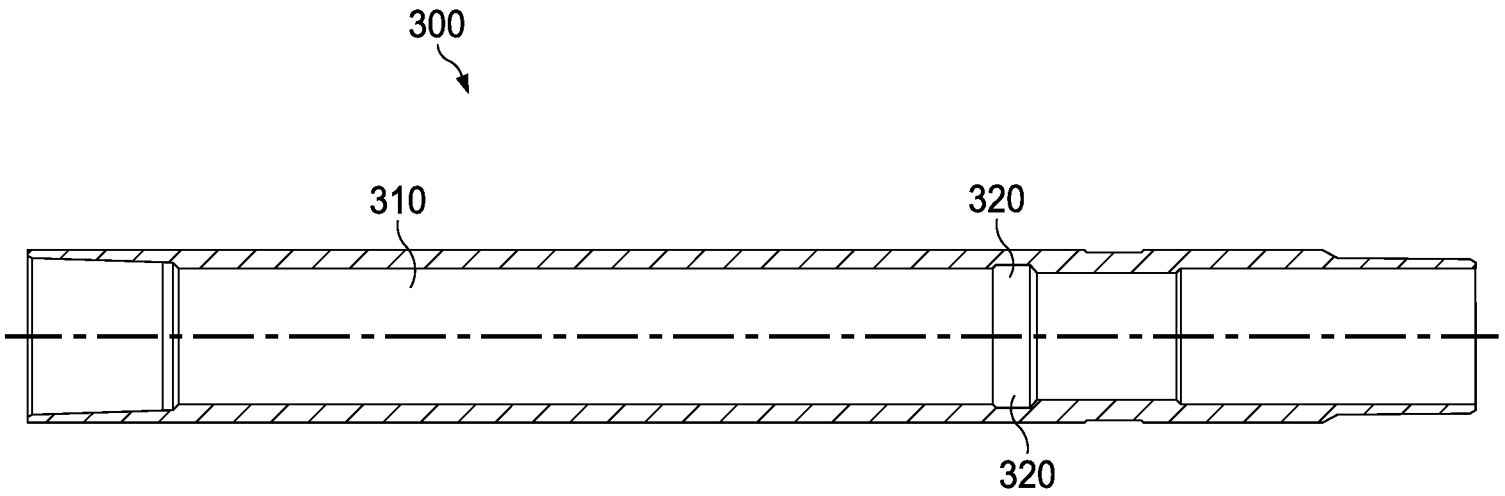
FIG. 4B shows a cross-sectional view of a landing nipple in accordance with one or more embodiments of the present invention.
Figure 4C:
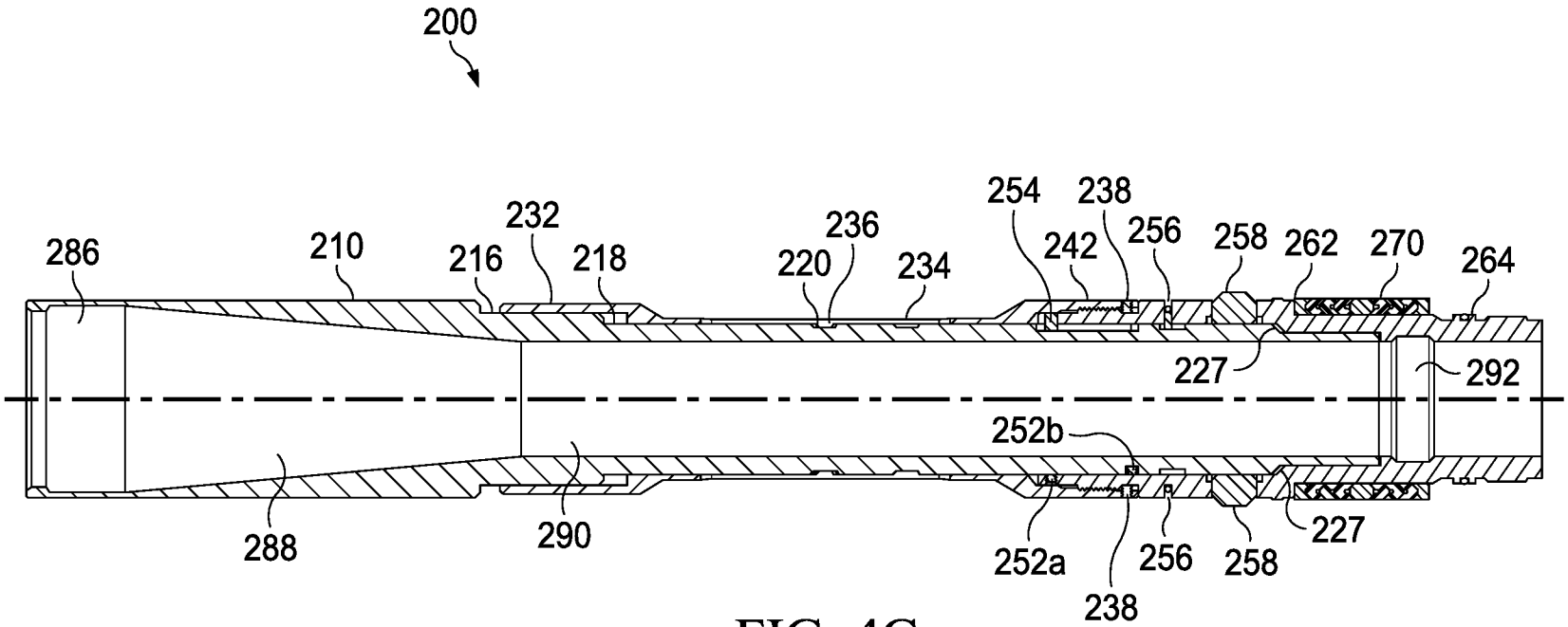
FIG. 4C shows a cross-sectional view of a high flow downhole lock assembly in a set configuration in accordance with one or more embodiments of the present invention.
Figure 4D:
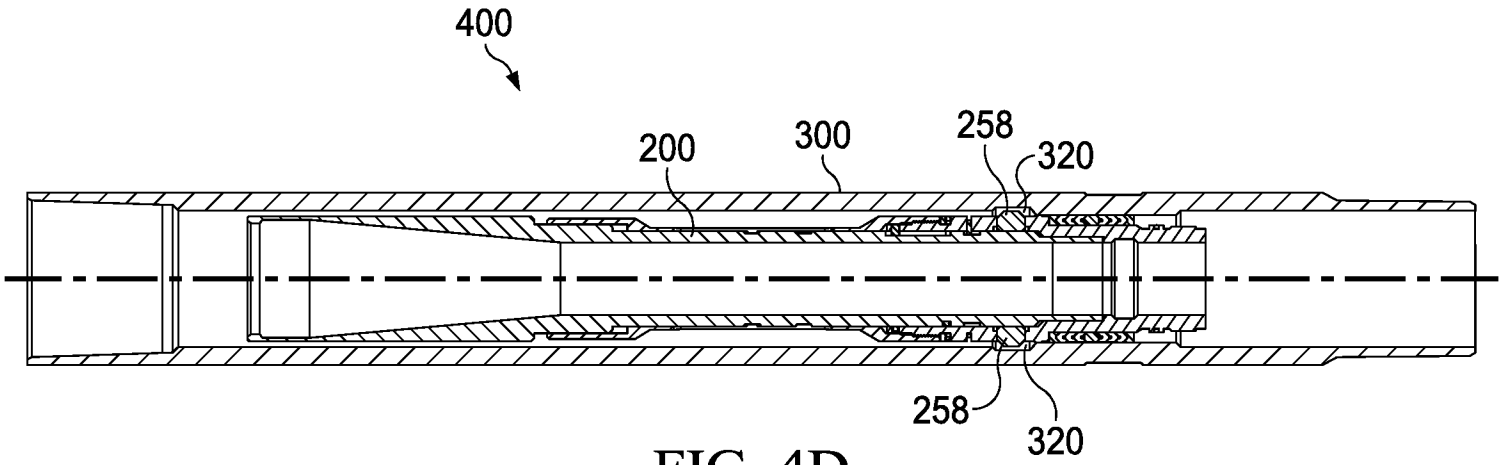
FIG. 4D shows a cross-sectional view of a high flow downhole lock assembly in a set configuration in a landing nipple in accordance with one or more embodiments of the present invention.

Continuing, FIG. 4B shows a cross-sectional view of a landing nipple 300 in accordance with one or more embodiments of the present invention. Landing nipple 300 may include an inner diameter 310 larger than the outer mandrel portion (214 of FIG. 4A) of the mandrel (200 of FIG. 4A) and a dog receiver portion 320 configured to receive a plurality of extendable retaining dogs (258 of FIG. 4A). Landing nipple 300 may be a conventional off-the-shelf landing nipple and may vary from manufacturer to manufacturer. The plurality of extendable retaining dogs (258 of FIG. 4A) may be interchangeable to fit within and mate to a given landing nipple 300. Continuing, FIG. 4C shows a cross-sectional view of a high flow downhole lock assembly 200 in a set configuration in accordance with one or more embodiments of the present invention. In this view, first inner mandrel portion 216 is in contact with, and seated within, the first distal interface portion 232 of external collet 230. The plurality of collet fingers 236 may be disposed in distal collet finger detent 220 on the left hand side, corresponding to the location nearest the top of the wellbore (not shown). The plurality of extendable retaining dogs 258 may be extended beyond the plurality of retaining dog ports 260. Continuing, FIG. 4D shows a cross-sectional view of a high flow downhole lock assembly 200 in a set configuration in a landing nipple 300 in accordance with one or more embodiments of the present invention. In this view, the plurality of extendable retaining dogs 258 are extended into dog receiver portion 320 of landing nipple 300, thereby securing lock assembly 200 in landing nipple 300.

Figure 5A:
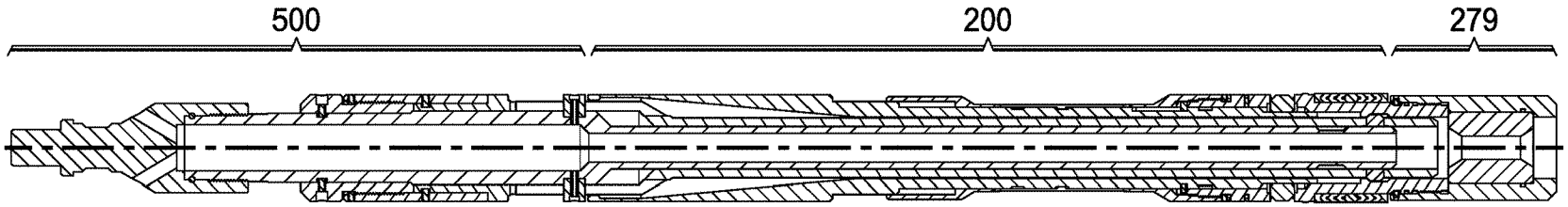
FIG. 5A shows a cross-sectional view of a high flow downhole lock assembly in a running configuration with a running tool attached to a first distal end and an orifice tool attached to a second distal end in accordance with one or more embodiments of the present invention.
Figure 5B:
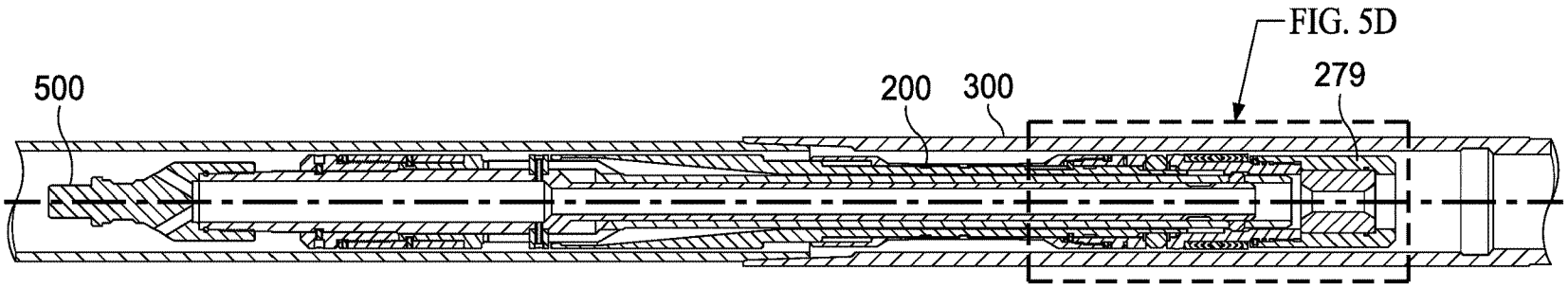
FIG. 5B shows a cross-sectional view of a high flow downhole lock assembly in a running configuration with a running tool attached to a first distal end and an orifice tool attached to a second distal end being inserted into a landing nipple in accordance with one or more embodiments of the present invention.
Figure 5C:
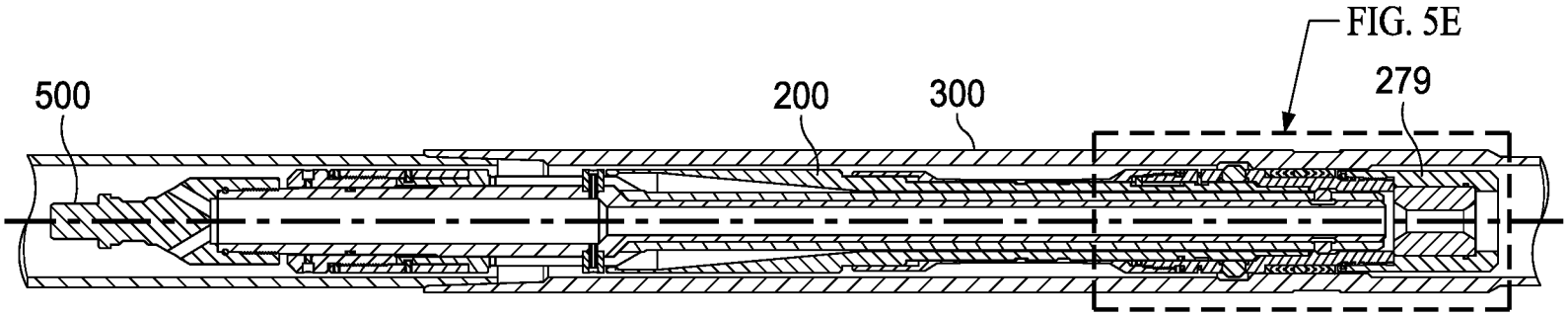
FIG. 5C shows a cross-sectional view of a high flow downhole lock assembly in a set configuration with a running tool attached to a first distal end and an orifice tool attached to a second distal end after being inserted into a landing nipple and set in accordance with one or more embodiments of the present invention.

FIG. 5A shows a cross-sectional view of a high flow downhole lock assembly 200 in a running configuration with a running tool 500 attached to a first distal end and an orifice tool 279 attached to a second distal end in accordance with one or more embodiments of the present invention. One of ordinary skill in the art will recognize that the orifice tool is merely exemplary and any other tool 279 may be used. Continuing, FIG. 5B shows a cross-sectional view of a high flow downhole lock assembly 200 in a running configuration with a running tool 500 attached to a first distal end and an orifice tool 279 attached to a second distal end being inserted into a landing nipple 300 in accordance with one or more embodiments of the present invention. In this view, the lock assembly 200 is being lowered into, but has not yet reached the landing depth of, the landing nipple 300. Continuing, FIG. 5C shows a cross-sectional view of a high flow downhole lock assembly 200 in a set configuration with a running tool 500 attached to a first distal end and an orifice tool 279 attached to a second distal end after being inserted into a landing nipple 300 and set in accordance with one or more embodiments of the present invention. In this view, the lock assembly 200 has been landed in the landing nipple 300 and a jarring action has been applied to the running tool 500 to set and secure lock assembly 200 in landing nipple 300.

Figure 5D:
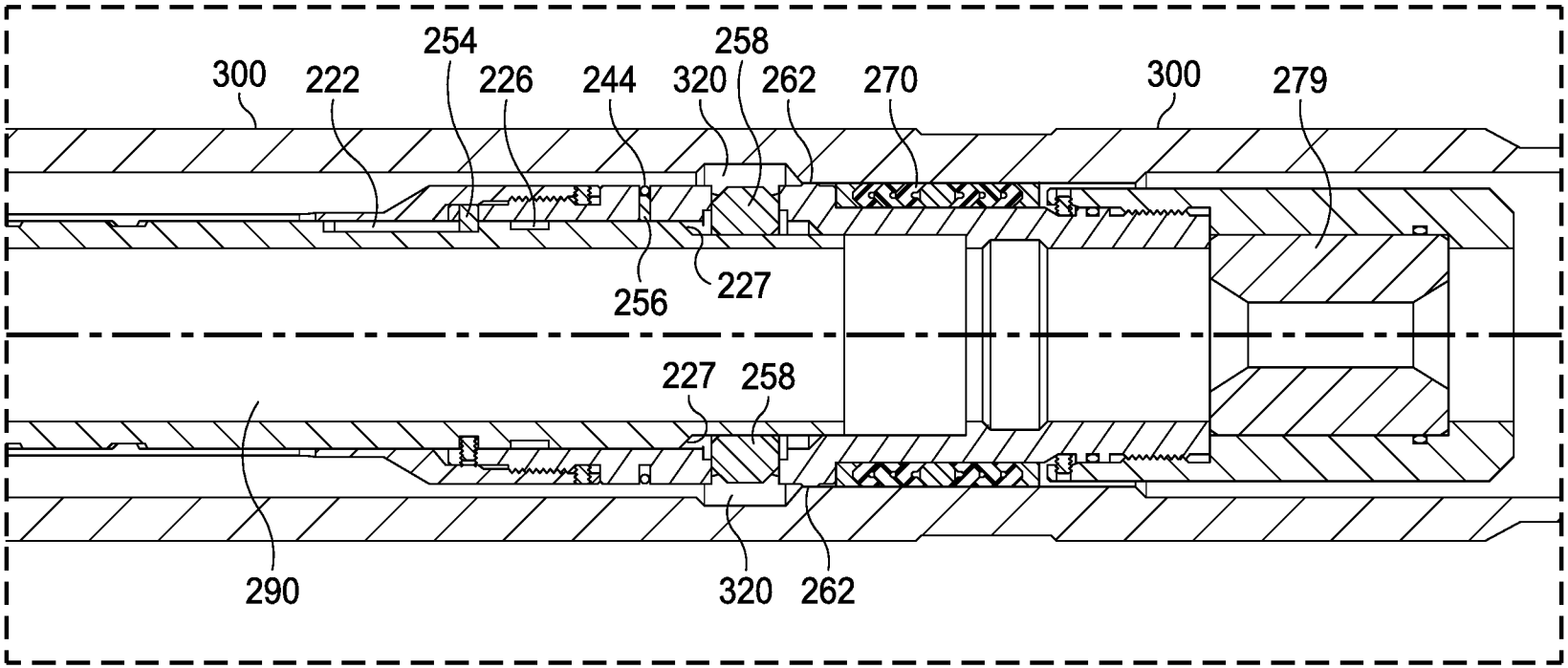
FIG. 5D shows a cross-sectional detail view of a portion of a high flow downhole lock assembly in a running configuration in a landing nipple prior to setting in accordance with one or more embodiments of the present invention.

Continuing, FIG. 5D shows a cross-sectional detail view from FIG. 5B of a portion of a high flow downhole lock assembly 200 in a running configuration in a landing nipple 300 prior to setting in accordance with one or more embodiments of the present invention. In the running configuration, a sloped interface 227 between the second inner mandrel portion 218 and the third inner mandrel portion 228 may be disposed to the left of the plurality of extendable retaining dogs 258, leaving the plurality of extendable retaining dogs 258 in the flush position. A plurality of recovery shear pins 256 may be radially biased by garter spring 244 and a plurality of retention pins 254 may be disposed in a distal end of a plurality of retention pin slots 222 closest to the bottom of the wellbore (not shown).

Figure 5E:
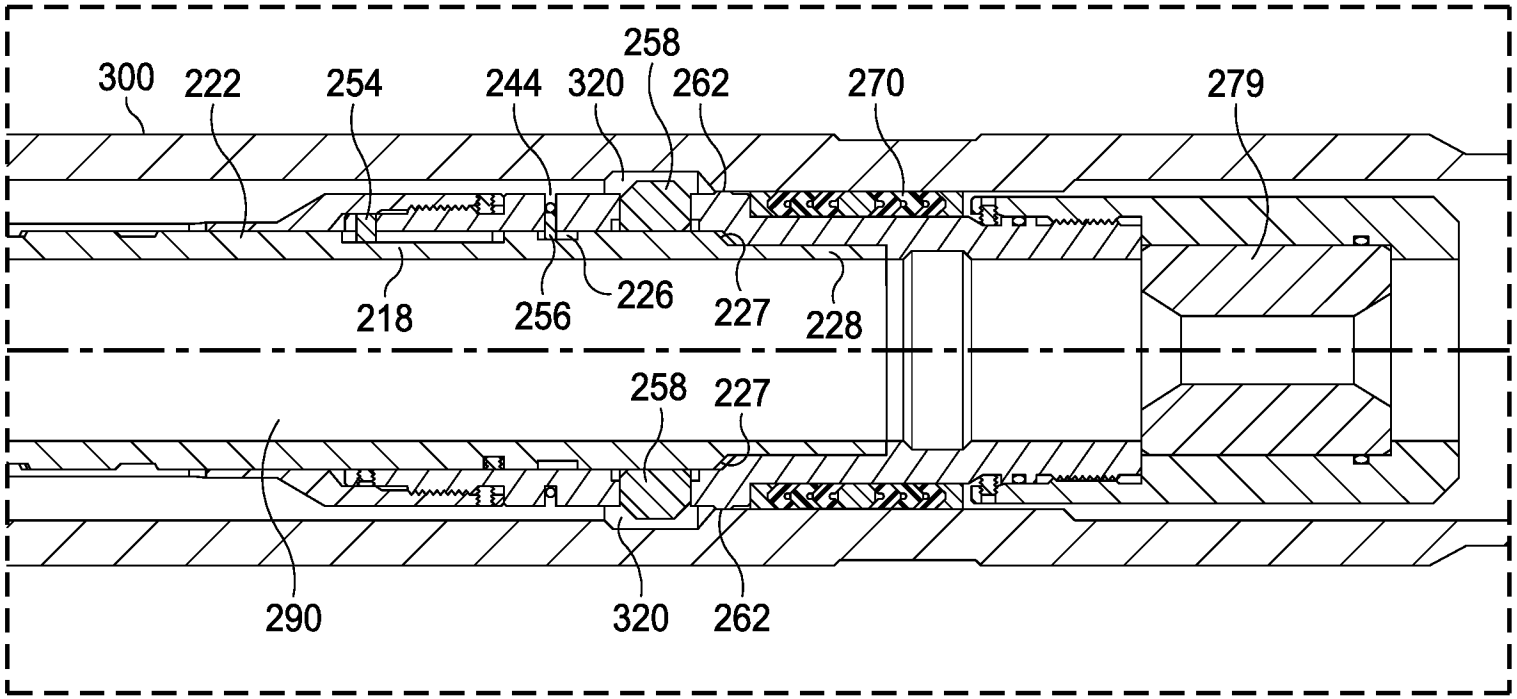
FIG. 5E shows a cross-sectional detail view of a portion of a high flow downhole lock assembly in a set configuration in a landing nipple after setting in accordance with one or more embodiments of the present invention.

Continuing, FIG. 5E shows a cross-sectional detail view from FIG. 5C of a portion of a high flow downhole lock assembly 200 in a set configuration in a nipple after setting in accordance with one or more embodiments of the present invention. When transitioning to the set configuration, a transition of contact from the third inner mandrel portion 228 to the second inner mandrel portion 218 along the sloped interface 227 with the plurality of extendable retaining dogs 258 causes the plurality of extendable retaining dogs 258 to be extended into the plurality of dog receivers 320 of landing nipple 300, thereby securing the lock assembly 200 in the landing nipple 300. The garter spring 244 drives the plurality of retention shear pins 256 to make contact with the recovery shear pin groove 226 as the recovery shear pin groove 226 moves in the downhole direction during setting. The plurality of retention pins 254 travel to an opposing distal end of the plurality of retention pin slots 222 closest to the top of the wellbore (not shown). In the set configuration, as shown in the figure, lock assembly 200 may be secured in place in landing nipple 300. Importantly, sheared portions of the plurality of recovery shear pins 256 remain outside the unobstructed inner diameter 290 and do not interfere with a nose piece attachment 279 during installation or operation. Because all locking mechanisms used to secure the lock assembly 200 in the landing nipple 300 are disposed outside of the unobstructed inner diameter 290, the inner diameter 290 allows for high flow rate injection while maintaining the lock assembly 200 secure in place in the landing nipple 300.

Advantages of one or more embodiments of the present invention may include one or more of the following:

In one or more embodiments of the present invention, a high flow downhole lock assembly provides all setting components outside the lock assembly such that the inner diameter of the assembly is unobstructed and free from encumbrance. Once set, the unobstructed inner diameter allows for higher injection rates, reduced turbulence, and reduced erosion during production or injection operations.

In one or more embodiments of the present invention, a high flow downhole lock assembly has an unobstructed and smooth inner diameter free from encumbrance that allows for high flow rates with improved flow characteristics.

In one or more embodiments of the present invention, a high flow downhole lock assembly has all setting components used to secure the assembly in a landing nipple disposed outside of the unobstructed inner diameter.

In one or more embodiments of the present invention, a high flow downhole lock assembly may be configured to land in a variety of commercially available landing nipples. Because the extendable retaining dogs are interchangeable, an appropriate type and shape of extendable retaining dog may be used to secure the lock assembly in a particular type of landing nipple.

In one or more embodiments of the present invention, a high flow downhole lock assembly has reduced turbulence within the inner diameter because the inner diameter is unobstructed, smooth, and free from encumbrance.

In one or more embodiments of the present invention, a high flow downhole lock assembly provides for lower internal velocities than a conventional lock assembly.

In one or more embodiments of the present invention, a high flow downhole lock assembly provides for improved flow characteristics than a conventional lock assembly.

In one or more embodiments of the present invention, a high flow downhole lock assembly has lower differential flowing pressures within the inner diameter because the inner diameter is unobstructed, smooth, and free from encumbrance.

In one or more embodiments of the present invention, a high flow downhole lock assembly has lower installed reaction forces which tends to make the lock assembly more secure when set in a landing nipple than a conventional lock assembly.

In one or more embodiments of the present invention, a high flow downhole lock assembly allows for higher injection rates than a conventional lock assembly.

In one or more embodiments of the present invention, a high flow downhole lock assembly has a larger inner diameter than a conventional lock assembly.

In one or more embodiments of the present invention, a high flow downhole lock assembly provides higher reliability than a conventional lock assembly. There is no potential for a recovery shear pin or set screw from entering the unobstructed inner diameter and fouling the nose piece attachment during installation or operation.

In one or more embodiments of the present invention, a high flow downhole lock assembly has a longer operational life than a conventional lock assembly. The inner diameter of the lock assembly may be coated with a protective coating to extend the operational life of the assembly.

In one or more embodiments of the present invention, a high flow downhole lock assembly may be used for both injection and production applications whereas conventional lock assemblies are only suitable for production applications where flow is from the bottom of the well to the top.

While the present invention has been described with respect to the above-noted embodiments, those skilled in the art, having the benefit of this disclosure, will recognize that other embodiments may be devised that are within the scope of the invention as disclosed herein. Accordingly, the scope of the invention should be limited only by the appended claims.

What is claimed is:

1. A high flow downhole lock assembly comprising:

a mandrel comprising a plurality of external collet finger detents disposed about an exterior surface and an unobstructed inner diameter configured for flow;

an external collet comprising a plurality of collet fingers disposed about an interior surface; and a dog housing comprising a plurality of extendable retaining dogs, wherein, when transitioning to a set configuration, a portion of the mandrel travels within the external collet, the plurality of collet fingers come to rest in one or more of the external collet finger detents, and the plurality of extendable retaining dogs are extended, and wherein, when in the set configuration, a plurality of recovery shear pins disposed in the dog housing make contact with a recovery shear pin groove of the mandrel to set the assembly in a landing nipple.

2. The high flow downhole lock assembly of claim 1, wherein the mandrel further comprises:

an outer mandrel portion having a first outer diameter smaller than a landing nipple inner diameter;

a first inner mandrel portion having a second outer diameter smaller than the first outer diameter;

a second inner mandrel portion having a third outer diameter smaller than the second outer diameter; and a third inner mandrel portion having a fourth outer diameter smaller than the third outer diameter, wherein the plurality of external collet finger detents are disposed about the exterior surface of the second inner mandrel portion.

3. The high flow downhole lock assembly of claim 2, wherein the mandrel further comprises:

a plurality of retention pin slots disposed along a longitidunal axis about an exterior of the second inner mandrel portion;

a recovery shear pin groove disposed about the exterior of the second inner mandrel portion; and a sloped interface between the second inner mandrel portion and the third inner mandrel portion.

4. The high flow downhole lock assembly of claim 3, wherein, when transitioning to the set configuration, a transition of contact from the third inner mandrel portion to the second inner mandrel portion along the sloped interface with the plurality of extendable retaining dogs causes the extendable retaining dogs to be extended.

5. The high flow downhole lock assembly of claim 3, wherein, when transitioning to the set configuration, a plurality of retention pins secured to the dog housing travel in the plurality of retention pin slots of the mandrel.

6. The high flow downhole lock assembly of claim 2, wherein a proximal end of the outer mandrel portion of the mandrel is configured to connect to a running tool.

7. The high flow downhole lock assembly of claim 1, wherein the external collet further comprises:

a proximal interface portion having a first inner diameter configured to receive a first inner mandrel portion of the mandrel;

a collet portion having a second inner diameter configured to receive a second inner mandrel portion of the mandrel, wherein the plurality of collet fingers are disposed about an interior surface of the second inner diameter; and a distal interface portion having the first inner diameter configured to connect to a proximal end of the dog housing.

8. The high flow downhole lock assembly of claim 1, wherein the dog housing further comprises:

a first dog housing portion having a first outer diameter configured to connect to a distal interface portion of the external collet;

a second dog housing portion having a second outer diameter larger than the first outer diameter; and a third dog housing portion having a third outer diameter smaller than the second outer diameter configured to connect to a nose piece attachment.

9. The high flow downhole lock assembly of claim 1, wherein the plurality of recovery shear pins are driven into the recovery shear pin groove by a coiled recovery pin spring.

10. The high flow downhole lock assembly of claim 9, wherein sheared portions of the plurality of recovery shear pins remain outside the unobstructed inner diameter of the mandrel and the assembly and do not interfere with a nose piece attachment during installation or operation.

11. The high flow downhole lock assembly of claim 1, wherein the high flow downhole lock assembly is configured to land and set in a conventional landing nipple.

12. The high flow downhole lock assembly of claim 1, wherein the unobstructed inner diameter of the mandrel is coated.

13. The high flow downhole lock assembly of claim 1, wherein all locking mechanisms used to secure the high flow downhole lock assembly in a landing nipple are disposed outside of the unobstructed inner diameter of the mandrel and the assembly.

14. The high flow downhole lock assembly of claim 1, further comprising:

a nose piece attachment configured to attach to a distal end of the dog housing.

15. The high flow downhole lock assembly of claim 14, wherein the nose piece attachment comprises:

a seal stack;

a first o-ring;

an insert;

a second o-ring;

a nose piece; and a plurality of set screws.

16. The high flow downhole lock assembly of claim 15, wherein the insert comprises a production safety valve, an injection safety valve, an anti-surge valve, a fixed orifice valve, an injection orifice, a storm choke, an isolation plug, a gauge, a cement retainer, or a combination thereof.

17. The high flow downhole lock assembly of claim 14, wherein the nose piece attachment comprises a production safety valve, an injection safety valve, an anti-surge valve, a fixed orifice valve, an injection orifice, a storm choke, an isolation plug, a gauge, a cement retainer, or a combination thereof.

* * * * *